US005205071A

United States Patent [19]

Hergenroeder

[11] Patent Number: 5,205,071

[45] Date of Patent: Apr. 27, 1993

[54] SURFING SANDAL

[76] Inventor: David J. Hergenroeder, 755 Hillside Dr., Solvang, Calif. 93463

[21] Appl. No.: 946,018

[22] Filed: Sep. 15, 1992

Related U.S. Application Data

[63] Continuation of Ser. No. 665,537, Mar. 6, 1991, abandoned.

[51] Int. Cl.[5] ..... A43B 5/08

[52] U.S. Cl. ..... 36/8.1; 36/11.5; 36/106

[58] Field of Search ..... 36/7.1 R, 7.2, 7.7, 36/8.1, 11.5, 62, 102, 105, 106, 114–116

[56] References Cited

U.S. PATENT DOCUMENTS

| | | | |
|---|---|---|---|
| 1,205,337 | 11/1916 | Donath | 36/62 |
| 2,486,886 | 11/1949 | Saukkonen | 36/8.1 |
| 2,954,617 | 10/1960 | Yamaguchi | 36/8.1 |
| 3,640,006 | 2/1972 | Kendrick | 36/8.1 |
| 4,271,605 | 6/1981 | Raczka | 36/7.2 |
| 4,301,603 | 11/1981 | Scott | 36/8.1 |
| 4,322,894 | 4/1982 | Dykes | 36/8.1 |
| 4,751,784 | 6/1988 | Petker et al. | 36/11.5 |
| 4,813,162 | 3/1989 | Harris | 36/11.5 |

FOREIGN PATENT DOCUMENTS

| | | | |
|---|---|---|---|
| 493536 | 5/1950 | Belgium | 36/7.7 |

*Primary Examiner*—Steven N. Meyers
*Assistant Examiner*—Thomas P. Hilliard
*Attorney, Agent, or Firm*—Christie, Parker & Hale

[57] ABSTRACT

A sandal particularly well suited for surfing has an instep pad adapted to extend across the instep at the top of the foot and a traction surface adapted to extend across the bottom of the foot between the heel and the ball of the foot. An ankle strap holds the pad and sole rearward while a toe strap holds the pad and sole forward. A cross strap over the foot near the leg prevents the ankle strap from falling down around the heel. A traction surface is applied to the sole and a second traction surface is applied to the toe strap below the base of the toe. The sandal is constructed of neoprene for warmth and flexibility and the traction pads are preferably formed from a rubber. Loop and pile fasteners allow the straps to be adjusted.

7 Claims, 3 Drawing Sheets

SURFING SANDAL

CROSS-REFERENCE TO RELATED APPLICATION

This is a continuation of Ser. No. 07/665,537, filed Mar. 6, 1991, now abandoned.

FIELD OF THE INVENTION

The present invention pertains to the field of footwear and particularly to a sandal adapted for surfing which protects the foot, improves traction and maintains the foot's feel of the board.

BACKGROUND OF THE INVENTION

A surfer spends a great amount of time lying on the surfboard in a prone position, and sitting with the knees on the surfboard resting back on the heels of the feet. Both of these positions push the insteps and toe joints of the feet against the surface of the surfboard resulting in uncomfortable abrasions and redness on the insteps and in excess calcium deposits on toe joints, a condition referred to as surfknots. A surfer's feet are also subject to cuts and bruises from the surfboard and the ocean floor. In addition, when the water is cold, a surfer's feet become cold and numb after long periods of surfing. To avoid these problems, a surfer can wear neoprene boots or slippers which provide an insulating and protective layer of neoprene. However, boots and slippers are difficult to surf with. Surfing requires the surfer to very accurately feel the movement of the surfboard under the effect of the waves on which it is traveling, and press against the surface of the surfboard in response. In other words, the surfer must both be able to feel the board and to control the board precisely and quickly with the feet. Neoprene boots and slippers cover the entire sole of the foot and make it difficult for the surfer to feel and control the surfboard. Many boots have a thicker reinforced sole for greater durability. This thicker sole makes control of the surfboard still more difficult. In addition, the bottom of most boots is not tightly held against the sole of the foot. Accordingly, greater foot movements are required to move the bottom of the boot toward and away from the surfboard than are required when barefoot reducing the precision with which the surfer can control the board with the feet. Unless water temperatures are very low, surfers prefer surfing barefoot because of the freedom of movement and the intimate contact with the surfboard which it allows.

SUMMARY OF THE INVENTION

The present invention protects the insteps and toes of a surfer's feet, helps to keep the feet warm, increases traction on the surfboard, and at the same time does not significantly diminish the surfer's ability to feel and control the surfboard while surfing. In one embodiment the invention encompasses a sandal for wear on a human foot, having an instep pad adapted to extend across the instep of the foot, and a sole fastened to the instep pad and adapted to extend around the bottom of the foot to hold the instep pad vertically against the instep. An ankle strap is fastened to the instep pad and adapted to extend around the back of the foot above the heel for holding the instep pad rearward against the instep. A forward strap is fastened to the instep pad and adapted to extend forward around a portion of the foot for holding the instep pad forward against the instep.

BRIEF DESCRIPTION OF THE DRAWINGS

These and other features of the invention will be more fully understood by referring to the following detailed description and accompanying drawings wherein.

DETAILED DESCRIPTION OF THE INVENTION

Figure 1:
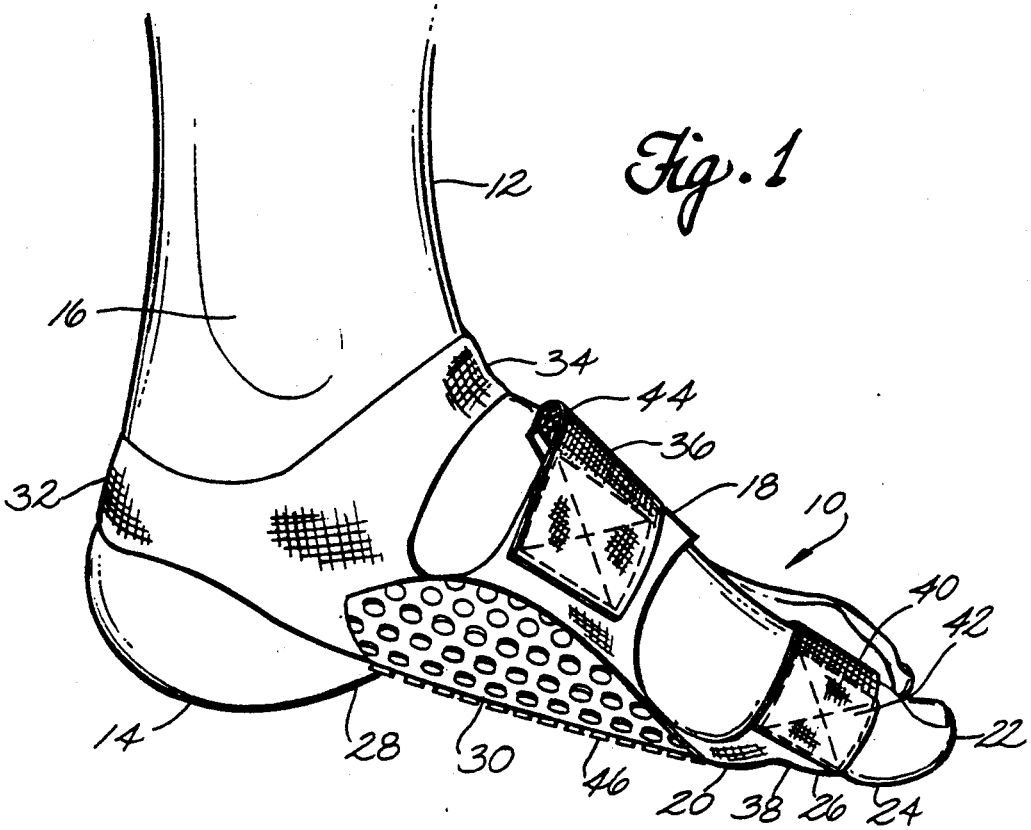
FIG. 1 is a side view of the inner side of a foot to which a sandal has been fitted according to the present invention.

FIG. 1 shows a typical foot 10 viewed from the side wearing a sandal constructed according to the present invention. The leg from which the foot extends is labeled 12. The foot's heel is labeled 14, the ankle 16, the instep 18, the ball 20, and the big toe 22, with a toe pad 24 and a base 26 at which the big toe is jointed to the rest of the foot. The sole of the foot is labeled 28. The ball of the foot extends across the entire width of the foot for purposes of this description.

Figure 3:
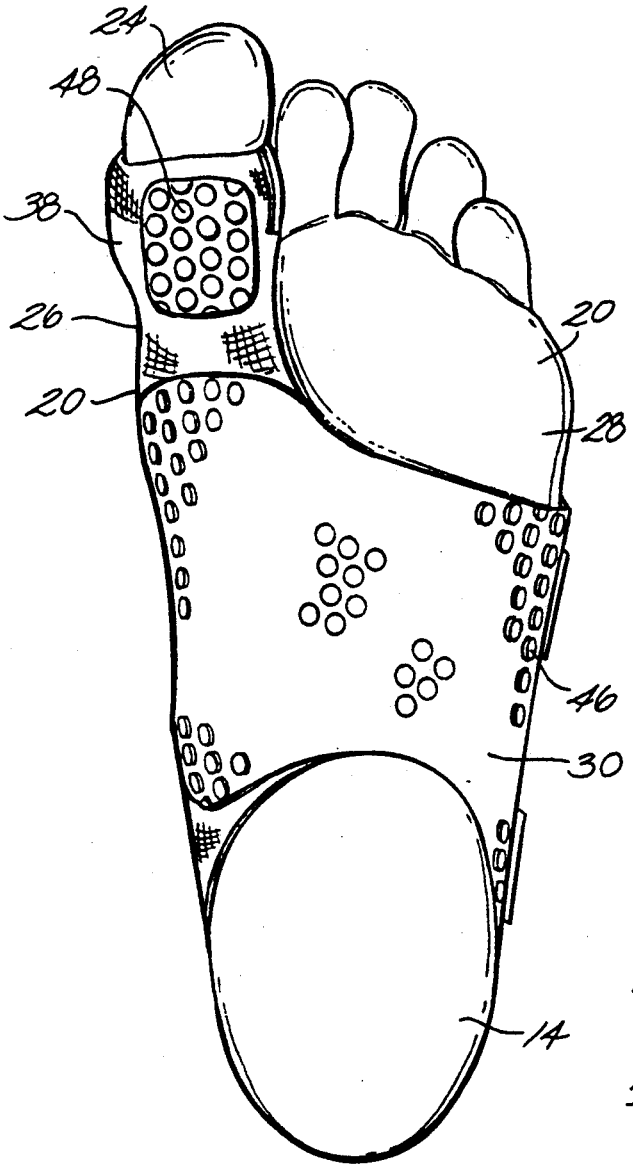
FIG. 3 is a bottom view of a foot to which the sandal of FIG. 1 has been fitted.
Figure 4:
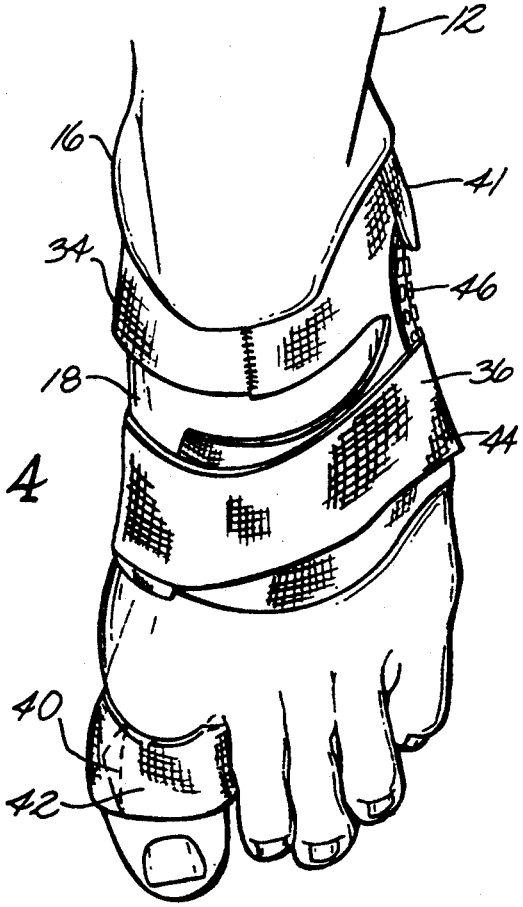
FIG. 4 is a top view of a foot to which the sandal of FIG. 1 has been fitted.
Figure 5:
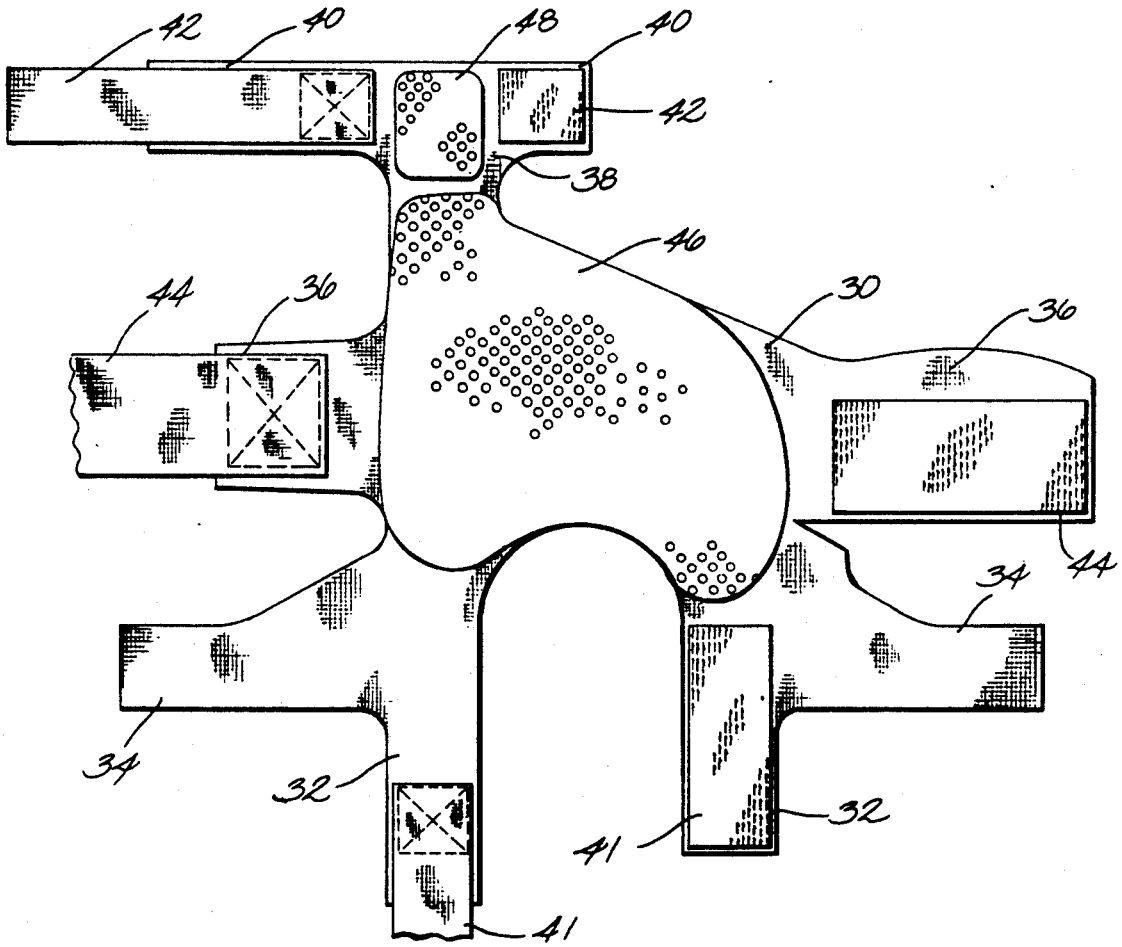
FIG. 5 is a bottom view of the sandal of FIG. 1 laid out flat with the straps disconnected.

The sandal is preferably cut from a single sheet of neoprene, as shown in FIG. 5, to form a variety of distinct yet interconnected parts. The largest portion is the sole 30 of the sandal. The sole is adapted to fit between the heel 14 and the ball 20 of the foot as best seen in FIG. 3. The ball of the foot from the second toe to the smallest toe is left completely uncovered as is the heel to maximize the surfer's feel for the surfboard. An ankle strap 32 extends from the sole in front of the heel around the back of the foot above the ankle. A cross strap 34 extends from the ankle strap near where it connects to the sole. The cross strap holds the ankle strap upward to prevent it from slipping downward around the bottom of the foot. The ankle strap not only helps to hold the sandal in place, but also protects the leg directly below the ankle. This area of the leg is commonly cut and bruised by the surfboard fin.

Directly above the sole is an instep strap 36. The instep strap is directly above the sole 30 of the sandal so that it extends across and covers the instep of the surfer's foot. The instep strap also helps to hold the sole of the sandal against the bottom of the surfer's foot. The instep strap being constructed primarily of neoprene (see, e.g., FIG. 5) serves as a pad between the instep of the surfer's foot and the top of the surfboard. The instep pad protects the instep from rubbing on the surfboard, and absorbs impacts of the board against the surfer's instep caused by waves and the like. It also reduces the pressure between the top at the surfer's toes and the surfboard, reducing the development of surfknots.

Extending forward from the primary sole 30 of the sandal is a second forward sole 38 which is adapted to fit at the base 26 of the big toe. A toe strap 40 is fastened to the second sole to hold the second sole in place at the base of the big toe. The second sole is preferably short enough that the toe's pad 24 is left completely uncovered so that the surfer's big toe pad rests on the surface of the surfboard while surfing to help the surfer to feel the board and to pivot the feet on the toes. The toe strap helps to keep both soles from moving backward on the bottom of the foot while the ankle strap prevents the soles from moving forward on the foot. The instep strap holds the primary sole upward against the bottom of the surfer's foot. The straps are preferably constructed of the same sheet of neoprene from which the soles and instep pad are cut, and the strap closures are preferably formed using loop and pile fasteners sewn onto the ends of the neoprene (see, e.g., FIG. 5.).

A loop and pile fastener 41 at the ankle strap allows the sandal to be adjusted for different leg thicknesses. A loop and pile fastener 42 at the toe strap allows the sandal to be adjusted for different size toes, and a loop and pile fastener 44 at the instep allows the sandal to be adjusted for feet with higher and flatter arches. It is presently preferred that the cross strap 34 be permanently sewed shut without benefit of a loop and pile fastener for durability and simplicity. It has been found that if the other three straps are adjustable, adjustability is not required for the cross strap, which serves primarily to prevent the ankle strap from falling down and slipping around the bottom of the heel. Adjustment is desired not only to fit the sandal to different footshapes but also to compensate for the stretching of the neoprene fabric as the sandal ages.

The sandal has two traction surfaces, a first traction surface 46 on the first sole of the sandal, and a second traction surface 48 on the second sole of the sandal below the base of the big toe. These traction surfaces are preferably formed from a textured soft rubber material. A nubby surface as shown in the drawings formed from nitrile rubber is presently preferred, although a variety of different materials can be used. The material is selected to provide a secure grip on a typical wet surfboard surface, yet still allow the foot to slide across the surfboard surface when desired. The particular material used can vary for different surfboard surfaces.

Figure 2:
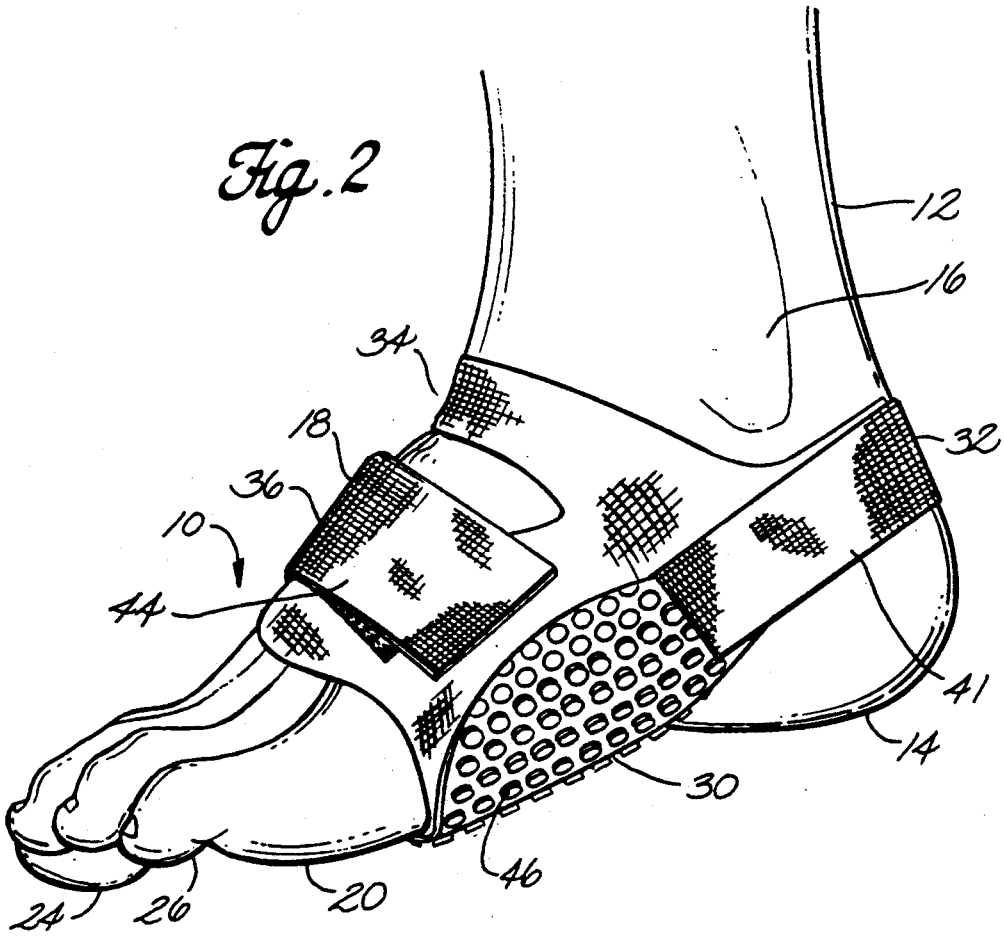
FIG. 2 is a side view of the outer side of a foot to which the sandal of FIG. 1 has been fitted.

As can be seen in FIGS. 1 and 2, the primary traction surface not only covers the bottom of the foot but extends partially up the sides of the feet as well. This allows the surfer to more easily grasp the surfboard with the edge of the foot when the surfer is starting to lose control of the surfboard and for difficult maneuvers. The second traction surface at the base of the toe is separated from the primary surface to avoid inhibiting toe movement. The second traction surface also leaves the toe pad bare for easy pivoting. When traction is desired, it is available however. The second traction surface is particularly helpful for reaching out with the toes to grab the opposite edge of the surfboard when the surfboard is rotating away from the surfer.

As best seen in FIGS. 2 and 3, the sandal of the present invention allows a feel very similar to that of surfing barefoot. The sandal covers primarily the arch of the foot on the bottom of the foot, and the base of the big toe. These surfaces normally do not touch the surfboard. The only part of the foot which is covered and normally touches the surfboard is that portion of the foot under the head of the first metatarsal directly behind the big toe. Yet the pad of the big toe remains exposed. The portion of the foot under the heads of the second through fifth metatarsals and extending to the anterior end of the arch remains exposed to contact the surf board. The amount of material is minimized so that the sandal covers only areas that need to be covered. This maximizes the surfer's feel leaving the foot in contact with the board to provide the feel of surfing barefoot yet providing greatly increased traction and protection on the surfboard.

While only a single embodiment has been described above, it is not intended to limit the scope of the present invention to that embodiment. Many modifications and adaptations can be made to the present invention without departing from its spirit and scope. The precise position and arrangement of straps can be varied. The size of the traction pads can be changed to suit different situations. The sandal can be adapted for use by sailboarders and for other activities where instep protection or a good feel and traction for a surface underfoot is required.

What is claimed is:

1. A surfing sandal to be worn on a wearer's foot having an instep, a big toe, a heel, and an arch, the sandal comprising:

an instep pad extending across the instep of the foot and covering that portion of the foot over the metatarsals whereby forces on the covered portion of the foot are mitigated by the pad when the wearer is kneeling on a surf board;

a flexible sole portion extending under the arch of the foot and integrally connected over an inner portion of the foot to a first end of the instep pad and over an outer portion of the foot to a second end of the instep pad, the sole portion further terminating at a posterior end of the arch of the foot to expose the heel and terminating at an anterior end of the arch to expose that portion of the foot under the head of the second through fifth metatarsals and extending to the anterior end of the arch, thereby allowing said exposed portion to directly contact a surf board, said sole portion further being highly pliable to snugly fit the contour of the arch of the foot gripping the foot in combination with the instep pad;

an ankle strap extending from the first end of the instep pad around the back of the foot above the heel to the second end of the instep pad, the attachment of the ankle strap substantially perpendicular to the attachment of the sole portion thereby urging the instep and sole portion firmly against the instep and arch of the foot respectively; and a forward strap encircling the big toe and attached to the sole portion under that portion of the foot under the head of the first metatarsal thereby constraining the sole portion from rearward movement.

2. A sandal as defined in claim 1 wherein the sole portion incorporates traction means extending from an inside surface of the foot under the arch to an outside surface of the foot whereby the traction means engage a surfboard on which the wearer is standing along a segment of the sole portion under an outer portion of the foot adjacent the arch and whereby lateral rolling of the foot by the wearer inward engages the traction means under the arch of the foot to the surf board and rolling of the foot laterally outward engages the traction means on the outside of the foot.

3. A sandal as defined in claim 1 wherein the instep pad comprises:

a first flap extending from the first end of the pad over the instep having a first moiety of a hook and pile fastener attached to an upper surface thereof; and, a second flap extending from the second end of the pad extending across the instep over the first flap and having a second moiety of a hook and pile fastener attached to an underside thereof.

4. A sandal as defined in claim 1 wherein the ankle strap comprises:

a first portion extending from the first end of the instep pad around the back of the foot, the first portion having a third moiety of a hook and pile fastening system attached thereto; and a second portion attached to the second end of the instep pad and having a fourth moiety of a hook and pile fastener for attachment to said third moiety.

5. A sandal as defined in claim 1 wherein the instep pad covers substantially the entire instep of the wearer whereby forces on the instep of the wearer when kneeling on a surfboard are mitigated by the pad.

6. A sandal as defined in claim 1 further comprising:

a cross strap extending from the ankle strap posterior from the connections of the ankle strap to the first and second ends of the instep pad, the cross strap extending over the top of the foot substantially perpendicularly to the ankle strap thereby preventing the ankle strap from sliding downward over the heel of the foot.

7. A sandal as defined in claim 2 wherein the traction means extend on the sole portion under a posterior portion of the big toe under the attachment of the forward strap and the sole portion of the sandal.

* * * * *